US006568368B1

(12) United States Patent
Boecking

(10) Patent No.: US 6,568,368 B1
(45) Date of Patent: May 27, 2003

(54) COMMON RAIL INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,373

(22) PCT Filed: Jun. 24, 2000

(86) PCT No.: PCT/DE00/02060

§ 371 (c)(1),
(2), (4) Date: Mar. 16, 2001

(87) PCT Pub. No.: WO01/06111

PCT Pub. Date: Jan. 25, 2001

(30) Foreign Application Priority Data

Jul. 16, 1999 (DE) ..... 199 33 328

(51) Int. Cl.[7] ..... F02M 47/00

(52) U.S. Cl. ..... 123/456; 123/468; 239/88; 239/585.5

(58) Field of Search ..... 239/88, 89, 90, 239/91, 92, 585.1, 585.4, 585.5; 123/456, 468, 462

(56) References Cited

U.S. PATENT DOCUMENTS 3,669,354 A * 6/1972 Helyer ..... 239/126
4,462,368 A * 7/1984 Funada ..... 123/446
4,667,638 A * 5/1987 Igashira et al. ..... 129/179.17
5,301,875 A * 4/1994 Gant et al. ..... 239/94
5,419,492 A * 5/1995 Gant et al. ..... 239/585.5
5,769,319 A * 6/1998 Yen et al. ..... 239/124
5,899,389 A * 5/1999 Pataki et al. ..... 239/533.2
6,247,452 B1 * 6/2001 Dittus et al. ..... 123/459
6,378,503 B1 * 4/2002 Lambert ..... 123/468
6,408,821 B1 * 6/2002 Desai et al. ..... 123/446
6,412,704 B2 * 7/2002 Shinogle et al. ..... 239/5

* cited by examiner

*Primary Examiner*—Tony M. Argenbright
*Assistant Examiner*—Hai Huynh
(74) *Attorney, Agent, or Firm*—Ronald E. Greigg

(57) ABSTRACT

The invention relates to a common rail injector for the injection of fuel in a common rail injection system of an internal combustion engine, which has an injector housing with a fuel inlet that communicates with a central high-pressure reservoir outside the injector housing and communicates with a pressure chamber inside the injector housing, from which highly pressurized fuel is injected depending on the position of a control valve, which assures that a nozzle needle, which can move axially back and forth in a longitudinal bore in the injector housing counter to the initial stress of a nozzle spring, lifts up from a seat when the pressure in the pressure chamber is greater than the pressure in a control chamber, which can be connected via an inlet throttle to the fuel inlet and can be connected via an outlet throttle to a relief chamber, and in order to produce a common rail injector which is simple in design and inexpensive to produce, the connection between the fuel inlet and the pressure chamber is disposed on the inside in relation to the control chamber.

20 Claims, 1 Drawing Sheet

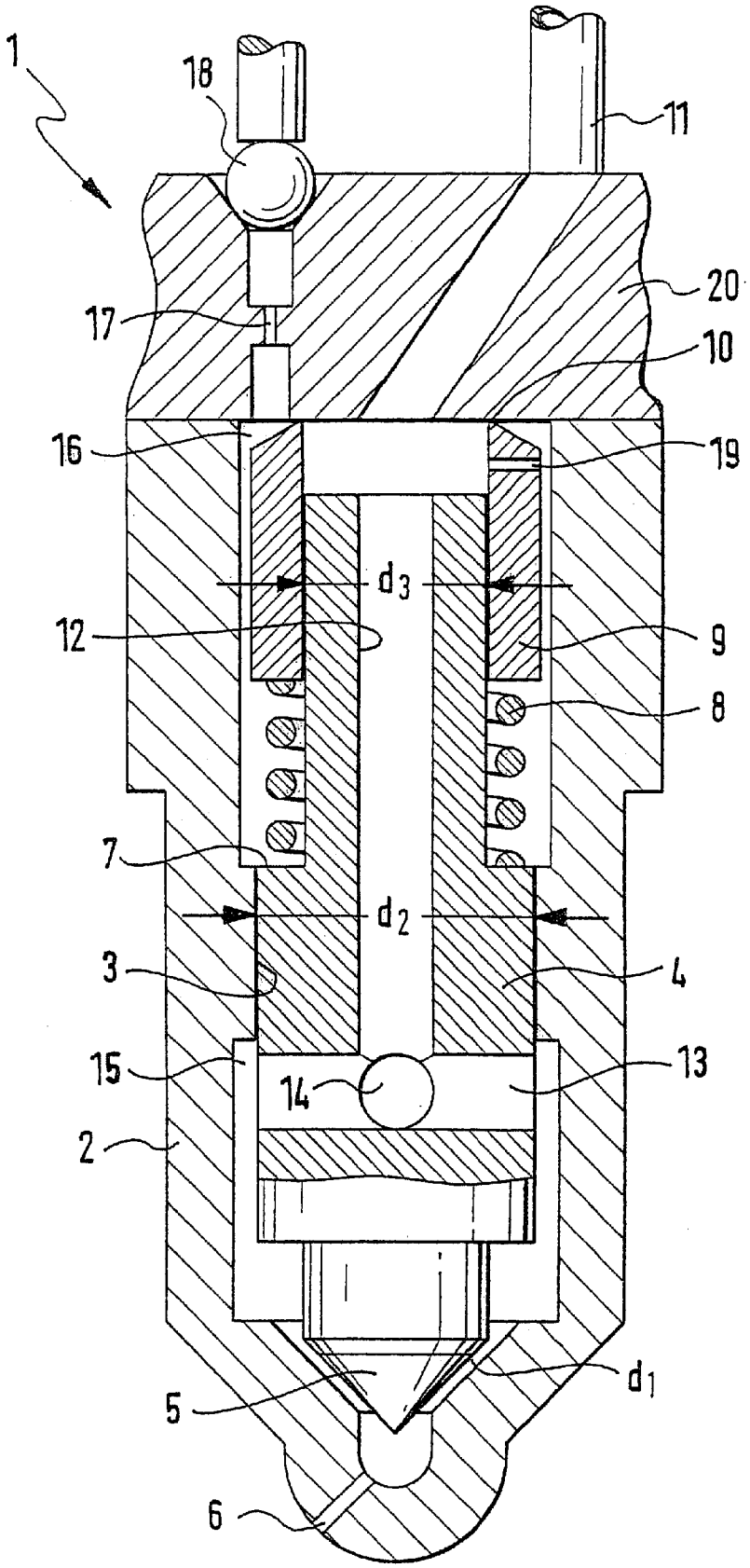
1
18
11
20
17
10
16
19
d3
12
9
8
7
d2
3
4
15
13
14
2
d1
5
6

COMMON RAIL INJECTOR

CROSS-REFERENCE TO RELATED APPLICATIONS

This application is a 35 USC 371 application of PCT/DE 00/02060 filed on Jun. 24, 2000.

BACKGROUND OF THE INVENTION

Field of the Invention

The invention relates to a common rail injector for fuel injection in a common rail injection system of an internal combustion engine, which has an injector housing with a fuel inlet which communicates with a central high-pressure fuel reservoir outside the injector housing and communicates with a pressure chamber inside the injector housing from which highly pressurized fuel is injected depending on the position of a control valve which assures that a nozzle needle, which can move axially back and forth in a longitudinal bore in the injector housing counter to the initial stress of a nozzle spring, lifts up from a seat when the pressure in the pressure chamber is greater than the pressure in a control chamber, which can be connected by means of an inlet throttle to the fuel inlet and can be connected by means of an outlet throttle to a discharge chamber.

In common rail injection systems, a high-pressure pump feeds the fuel into the central high-pressure reservoir which is referred to as a common rail. High-pressure lines lead from the high-pressure reservoir to the individual injectors which are associated with the engine cylinders. The injectors are individually triggered by the engine electronics. The rail pressure prevails in the pressure chamber and at the control valve. When the control valve opens, the nozzle needle lifts up from its seat and highly pressurized fuel is injected into the combustion chamber of the engine.

In conventional injectors of the type disclosed, for example, by reference to German Patent No. 197 24 637 A1, the control chamber is disposed centrally in the injector housing, at the end of the longitudinal bore remote from the combustion chamber. The connection between the fuel inlet and the pressure chamber is produced by means of a bore that extends outside the longitudinal bore. This additional bore in the injector housing is subjected to the full rail pressure, at least during injection. As a result, insuring that the sealing of the injector housing occurs is quite a complex operation in terms of manufacturing engineering.

OBJECTS OF THE INVENTION

The principal object of the invention is to produce a common rail injector of the type described hereinbefore yet which has a simple design and is inexpensive to produce.

It is another object of the invention that the seal effectiveness should be improved.

SUMMARY OF THE INVENTION

In a common rail injector for the injection of fuel in a common rail injection system of an internal combustion engine, which has an injector housing with a fuel inlet which communicates with a central high-pressure fuel reservoir outside the injector housing and communicates with a pressure chamber inside the injector housing from which highly pressurized fuel is injected depending on the position of a control valve which assures that a nozzle needle, which can move axially back and forth in a longitudinal bore in the injector housing counter to the initial stress of a nozzle spring, lifts up from a seat when the pressure in the pressure chamber is greater than the pressure in a control chamber. The control chamber can be connected by means of an inlet throttle to the fuel inlet and can be connected by means of an outlet throttle to a discharge chamber so that the object of the invention is attained by virtue of the fact that the communication between the fuel inlet and the pressure chamber is disposed on the inside in relation to the control chamber. The design of the injector according to the invention is practically the reverse of the design of conventional injectors. By means of this measure, the high-pressure sealing of the injector housing is considerably simplified in terms of manufacturing engineering.

In one embodiment of the invention the nozzle needle has a central bore via which the fuel inlet communicates with the pressure chamber. The bore in the nozzle needle has the same function as the bore in the injector housing of conventional injectors. As a result of the embodiment of the injector according to the invention, the injector housing can be embodied [as] more compactly.

In another embodiment of the invention there is provided on the nozzle needle between the fuel inlet and the pressure chamber, at least one flat surface along which fuel can travel from the fuel inlet into the pressure chamber. This embodiment offers advantages particularly with regard to the high-pressure impermeability of the injector.

In yet another embodiment of the invention the central bore is an axial blind bore whose end communicates with the pressure chamber by means of at least one radial bore. If four radial bores extend out from the blind bore in a star shape, the highly pressurized fuel is distributed uniformly in the annular pressure chamber.

In still another embodiment of the invention the control chamber is disposed between the inner circumferential surface of the longitudinal bore and the outer circumferential surface of a sleeve, which can be slid in a sealed fashion onto the end of the nozzle needle remote from the combustion chamber and is held in contact with the injector housing with the aid of the nozzle spring. The sleeve provides a simple way of separating the control chamber from the fuel inlet.

In a further embodiment of the invention a biting edge is disposed on the surface of the sleeve which contacts the injector housing. This edge insures that the control chamber embodied outside the sleeve remains separate from the fuel inlet inside the sleeve in a pressure-tight manner.

In another embodiment of the invention the nozzle needle is guided between the control chamber and the pressure chamber. The nozzle needle of the injector according to the invention can be embodied as shorter than conventional nozzle needles. Therefore, a guide is required in order to assure a trouble-free operation of the injector.

In yet another embodiment of the invention the inlet throttle is integrated into the sleeve. The inlet throttle serves to prevent pressure surges during operation.

In still another embodiment of the invention the nozzle needle has a step embodied on it, which constitutes a stop for the nozzle spring. This design has the advantage that it is no longer necessary to provide a spring plate. This reduces the number of individual parts.

Yet another embodiment of the invention provides that the nozzle needle stroke is defined by the distance between injector housing and the end face of the nozzle needle remote from the combustion chamber. This embodiment has the advantage that it is particularly easy to produce in terms of manufacturing engineering.

Other advantages, features, and details of the invention ensue from the following description in which an exemplary embodiment of the invention is described in detail, with reference to the drawing. The features mentioned in the claims and the specification can be essential to the invention either individually or in arbitrary combinations with one another.

BRIEF DESCRIPTION OF THE DRAWINGS

The exemplary embodiment of the injector according to the invention is shown in a longitudinal section in the sole FIGURE.

DESCRIPTION OF THE PREFERRED EMBODIMENTS

The injector of the invention has an injector housing, which is labeled as a whole with the reference numeral 1. The injector housing 1 includes a nozzle body 2, which protrudes with its lower free end into the combustion chamber of the engine to be supplied. With its upper end face remote from the combustion chamber, the nozzle body 2 is prestressed axially against a valve body 20 and an injector body (not shown) with the aid of a tension nut (not shown).

An axial guide bore 3 is provided in the nozzle body 2. A nozzle needle 4 with a tip 5 is guided so that it can move axially in the guide bore 3. At the tip 5 of the nozzle needle 4, there is a sealing surface, which cooperates with a sealing seat embodied on the nozzle body 2. When the tip 5 of the nozzle needle 4 is disposed with its sealing surface in contact with the sealing seat, an injection port 6 in the nozzle body 2 is closed. When the nozzle needle tip 5 lifts up from its seat, the highly pressurized fuel is injected through the injection port 6 into the combustion chamber of the engine.

Starting from the tip 5, the nozzle needle 4 has three regions with different diameters $d_1$, $d_2$, and $d_3$. The diameter $d_2$ is the largest and is used to guide the nozzle needle 4 in the nozzle body 2. The diameter $d_1$ is also referred to as the seat diameter and is slightly smaller than the nozzle needle diameter $d_3$. The nozzle needle diameter $d_3$ is smaller than the guide diameter $d_2$. The diameter $d_3$ is also referred to as the control diameter and the diameter $d_2$ is referred to as the guide diameter.

The difference between the diameters $d_2$ and $d_3$ produces a step 7 on the nozzle needle 4. A nozzle spring 8 is disposed in contact with the step 7. The other end of the nozzle spring 8 is disposed in contact with the lower end face of a sleeve 9. In this way, the nozzle spring 8 is prestressed between the step 7 and the sleeve 9. On the one hand, the initial stress of the nozzle spring 8 assures that the tip 5 of the nozzle needle 4 is pressed against its seat and on the other hand, this initial stress assures that the upper end face of the sleeve 9 is pressed against the valve body 20. A biting edge 10 is embodied on the upper end face of the sleeve 9 remote from the combustion chamber. The inner diameter of the sleeve 9 is slightly greater than the diameter $d_3$ of the nozzle needle 4. The end of the nozzle needle 4 remote from the combustion chamber can be moved in a sealed fashion in the sleeve 9. In this manner, the inner chamber of the sleeve 9 is protected from the environment in a pressure-tight way.

A fuel inlet 11 that is embodied in the valve body 20 feeds into the inner chamber of the sleeve 9. At the beginning, a central axial bore 12 extends in the nozzle needle 4 until it reaches the level of a pressure chamber 15. At the level of the pressure chamber 15, two radial through bores 13 and 14 are disposed crosswise in the nozzle needle 4. The radial bores 13 and 14 produce a connection between the pressure chamber 15 and the axial bore 12.

The highly pressurized fuel travels from the rail via the fuel inlet 11, the inner chamber of the sleeve 9, the axial bore 12, and the radial bores 13 and 14, and into the pressure chamber 15. The nozzle needle 4 is partially force balanced through the selected diametrical relationships between the diameters $d_1$, $d_2$, and $d_3$. The nozzle needle tip 5 is pressed against its seat by the initial tension of the nozzle spring 8.

A control chamber 16 is embodied between the outer circumferential surface of the sleeve 9 and the inner circumferential surface of the longitudinal bore 3 at the end of the nozzle needle body 2 remote from the combustion chamber. An inlet throttle 19 connects the control chamber 16 to the inner chamber of the sleeve 9 and therefore to the fuel inlet 11. Thus the rail pressure initially also prevails in the control chamber 16.

An outlet throttle 17 can connect the control chamber 16 to a pressure relief chamber (not shown), depending on the position of a control valve member 18. If this is the case, the pressure in the control chamber 16 falls below the rail pressure and the previously balanced relationship between the pressure-exposed surfaces of the nozzle needle 4 no longer exists. This causes the nozzle needle 4 to lift up from its seat and highly pressurized fuel is injected from the pressure chamber 15 into the combustion chamber of the engine. If the connection to the relief chamber is interrupted by the control valve member 18, the pressure in the control chamber 16 increases again slowly and the nozzle needle 4 closes.

The sleeve 9 is force balanced due to its geometric dimensions. The biting edge 10 is disposed on the inner diameter of the sleeve 9.

The foregoing relates to preferred exemplary embodiments of the invention, it being understood that other variants and embodiments thereof are possible within the spirit and scope of the invention, the latter being defined by the appended claims.

I claim:

1. A common rail injector for the injection of fuel in a common rail injection system of an internal combustion engine, which has an injector housing (1) provided with a fuel inlet (11) that communicates with a central high-pressure reservoir outside the injector housing (1) and further communicates with a pressure chamber (15) disposed inside the injector housing (1), from which pressure chamber highly pressurized fuel is injected depending on a position of a control valve (18), which control valve acts to assure that a nozzle needle (4), which is disposed to move axially back and forth in a longitudinal bore (3) provided in the injector housing (1) counter to an initial stress of a nozzle spring (8), lifts up from a seat when a first pressure in the pressure chamber (15) is greater than a second pressure in a control chamber (16), which control chamber is connectable via an inlet throttle (19) to the fuel inlet (11) and is connectable via an outlet throttle (17) to a relief chamber, and a connection means (12, 13, 14) linking the fuel inlet (11) and the pressure chamber (15) is disposed on an inside in relation to the control chamber (16).

2. The common rail injector according to claim 1, further wherein the nozzle needle (4) has a central bore (12) via which the fuel inlet (11) is connected to the pressure chamber (15).

3. The common rail injector according to claim 1, further wherein the nozzle needle (4) between the fuel inlet (12) and the pressure chamber (15), at least one flat surface is embodied, along which surface fuel can travel from the fuel inlet (11) to the pressure chamber (15).

4. The common rail injector according to claim 1, in which the control chamber (16) is disposed between an inner circumferential surface of the longitudinal bore (3) and an outer circumferential surface of a sleeve (9), which sleeve can be slid in a sealed fashion onto an end of the nozzle needle (4) remote from the combustion chamber and is held in contact with the injector housing (1) with the aid of the nozzle spring (8).

5. The common rail injector according to claim 4, further wherein a biting edge (10) is disposed on a surface of the sleeve (9) which contacts the injector housing (1).

6. The common rail injector according to claim 1, in which the inlet throttle (19) is integrated into the sleeve (9).

7. The common rail injector according to claim 1, in which the nozzle needle (4) has a step (7) embodied on it, which constitutes a stop for the nozzle spring (8).

8. The common rail injector according to claim 1, in which a stroke of the nozzle needle is defined by a distance between the injector housing (1) and the end face of the nozzle needle (4) remote from the combustion chamber.

9. An injector for injecting fuel into an internal combustion engine, which injector has an injector housing (1) provided with a fuel inlet (11) that communicates with a pressure chamber (15) disposed inside the injector housing (1), from which pressure chamber highly pressurized fuel is injected, wherein a nozzle needle (4), which is disposed to move axially back and forth in a longitudinal bore (3) provided in the injector housing (1) counter to an initial stress of a nozzle spring (8), lifts up from a seat when a first pressure in the pressure chamber (15) is greater than a second pressure in a control chamber (16), which control chamber is connectable via an inlet throttle (19) to the fuel inlet (11) and is connectable via an outlet throttle (17) to a relief chamber, and a connection means (12, 13, 14) linking the fuel inlet (11) and the pressure chamber (15) is disposed on an inside in relation to the control chamber (16).

10. The common rail injector according to claim 9, further wherein the nozzle needle (4) has a central bore (12) via which the fuel inlet (11) is connected to the pressure chamber (15).

11. The common rail injector according to claim 10, further wherein the central bore is an axial blind bore (12) whose end communicates with the pressure chamber (15) by means of at least one radial bore (13, 14).

12. The common rail injector according to claim 9, further wherein the nozzle needle (4) between the fuel inlet (12) and the pressure chamber (15), at least one flat surface is embodied, along which surface fuel can travel from the fuel inlet (11) to the pressure chamber (15).

13. The common rail injector according to claim 9, in which the control chamber (16) is disposed between an inner circumferential surface of the longitudinal bore (3) and an outer circumferential surface of a sleeve (9), which sleeve can be slid in a sealed fashion onto an end of the nozzle needle (4) remote from the combustion chamber and is held in contact with the injector housing (1) with the aid of the nozzle spring (8).

14. The common rail injector according to claim 13, further wherein a biting edge (10) is disposed on a surface of the sleeve (9) which contacts the injector housing (1).

15. The common rail injector according to claim 14, in which the inlet throttle (19) is integrated into the sleeve (9).

16. The common rail injector according to claim 13, in which the inlet throttle (19) is integrated into the sleeve (9).

17. The common rail injector according to claim 9, in which the nozzle needle (4) is guided between the control chamber (16) and the pressure chamber (15).

18. The common rail injector according to claim 17, in which the inlet throttle (19) is integrated into the sleeve (9).

19. The common rail injector according to claim 9, in which the nozzle needle (4) has a step (7) embodied on it, which constitutes a stop for the nozzle spring (8).

20. The common rail injector according to claim 9, in which a stroke of the nozzle needle is defined by a distance between the injector housing (1) and the end face of the nozzle needle (4) remote from the combustion chamber.

* * * * *

UNITED STATES PATENT AND TRADEMARK OFFICE

CERTIFICATE OF CORRECTION

PATENT NO. : 6,568,368 B1
DATED : May 27, 2003
INVENTOR(S) : Friedrich Boecking

It is certified that error appears in the above-identified patent and that said Letters Patent is hereby corrected as shown below:

Title page,
Item [86], should read as follows:

-- [86] PCT No.: PCT/DE00/02060

371(c)(1),
(2), (4) Date: JULY 27, 2001 --

Signed and Sealed this

Ninth Day of September, 2003

JAMES E. ROGAN
*Director of the United States Patent and Trademark Office*